United States Patent [19]

Collar

[11] 3,938,709

[45] Feb. 17, 1976

[54] GAS PRESSURE ACTUATED PLASTIC SQUEEZE DISPENSER AND VALVING MEANS THEREFOR

[75] Inventor: Roland W. Collar, Sun Valley, Calif.

[73] Assignee: Techon Systems, Inc., Gardena, Calif.

[22] Filed: Feb. 25, 1974

[21] Appl. No.: 445,797

Related U.S. Application Data

[63] Continuation of Ser. No. 246,542, April 24, 1972, abandoned.

[52] U.S. Cl. ..... 222/95; 222/325; 277/212 C

[51] Int. Cl.[2] ..... B65D 35/28

[58] Field of Search ..... 277/212 C, 212 R; 222/93, 222/105, 173, 95, 386.5, 389, 325, 105; 29/235

[56] References Cited

UNITED STATES PATENTS

| | | | |
|---|---|---|---|
| 1,458,698 | 6/1923 | Greve | 222/389 |
| 3,439,839 | 4/1969 | Schumann et al. | 222/95 |
| 3,677,443 | 7/1972 | Smadat | 222/95 |

FOREIGN PATENTS OR APPLICATIONS

| | | | |
|---|---|---|---|
| 800,138 | 8/1958 | United Kingdom | 222/95 |

*Primary Examiner*—Robert B. Reeves
*Assistant Examiner*—H. Grant Skaggs, Jr.
*Attorney, Agent, or Firm*—William H. Pavitt, Jr.

[57] ABSTRACT

A plastic material squeeze tube dispenser comprising an elongated conical housing having an opening at one end through which is passed in a sealed manner the nozzle end of a squeeze tube containing a plastic material to be dispensed therefrom. A handle body is attached to the housing and includes a trigger actuatable valve means whereby gas under pressure from a source connected to the handle body may be admitted into the housing to apply pressure to the squeeze tube. Upon release of the trigger, the gas then in the housing is vented to the atmosphere to reduce the pressure within the housing to the ambient level. The valve means is constructed so that when operated, no gas from the pressure source can escape directly through the vent, but only after it has been utilized within the housing.

2 Claims, 5 Drawing Figures

GAS PRESSURE ACTUATED PLASTIC SQUEEZE DISPENSER AND VALVING MEANS THEREFOR

CROSS-REFERENCE TO RELATED APPLICATIONS

This is a continuation application of application Ser. No. 246,542, filed on Apr. 24, 1972 and now abandoned, of Roland W. Collar for GAS PRESSURE ACTUATED PLASTIC SQUEEZE DISPENSER AND VALVING MEANS.

BACKGROUND OF THE INVENTION

1. Field of the Invention

This invention relates broadly to the field of devices for controllably squeezing out the plastic contents from squeeze tubes in which they may be contained, but has particular application to those tubes of plastic building type compounds which are utilized in the construction and vehicle manufacturing industries for caulking, filling, adhering and other purposes.

2. Description of the Prior Art

Controllably dispensing the contents of squeeze tubes has represented a challenge to inventors ever since the first of such tubes were commercially presented to the public. In the early days, since such tubes principally contained toothpaste or cosmetic creams, the devices which were created usually involved some single mechanical means for rolling up the end of the tube or providing some vice-type compression. For such domestic and non-industrial uses, obviously one would not consider providing any type of air or gas compression squeezing means.

In the aircraft and building fields, however, for quite a number of years plastic caulking compounds, such as those of polysulfide, have been packed in cylindrical containers from one end of which the material is extruded when the other end is subjected to a compressed air or gas force applied to some type of plunger which can move axially down the cylindrical container. An example of such a device is that described and illustrated in U.S. Pat. No. 2,838,210 granted to Detrie, et al., on Dec. 21, 1954.

One difficulty with such prior art devices, however, is that the plastic material to be dispensed must first be packed in a cartridge which fits the particular gun-like compressed air device. Where large amounts of the material are to be dispensed and on a regular basis, the use of such a device can be well justified. However, where only small amounts are to be dispensed from time to time—particularly out "in the field"—the use of large cartridges of material which fit into air gun devices presents a number of problems:

One of such problems is that the gun devices with their gas tanks and cartridges may be somewhat bulky and inconvenient to carry around. Another problem is that once the cartridge has been partly used, the remaining material may tend to "set up" in the cartridge unless used fairly soon thereafter. Still another problem with prior art devices is that the valving means have been wasteful of the compressed gas in that each time the trigger is pulled and released, there has been a momentary passage of the compressed gas from the bottle or other pressure container source through the valve to the atmosphere. Such wastage of the compressed gas can materially cut the operational time of a dispenser which is operated by gas from a small portable gas bottle in the field.

For some time, caulking compounds have been sold in squeeze tubes and these are quite useful for small and selective applications. Usually, with such tubes, there is provided both (i) a closure cap, which may be screwed onto the discharging end of the tube to completely cap the same and thereby prevent a setting up of the contained compound between periods of partial use thereof; and (ii) a conical dispensing nozzle which is substituted for the closure cap when it is desired to extrude any of the compound from the tube. However, heretofore, no one has devised any type of dispenser in which gas under pressure can be utilized controllably to extrude plastic material from a squeeze tube using the tube's own plastic nozzle, and where, upon completion of partial extrusion from the tube, the latter may be removed from the actual compressed gas dispenser and reclosed with its cap. In such devices, as have been developed to dispense the contents of squeeze tubes by the application of gas under pressure, the dispensing end of the tube has been inserted into a nozzle which is a part of the dispenser housing. Consequently, with each use, such housing nozzle becomes blocked by the tacky polysulfide or silicone caulking compound and must be immediately cleaned following each use. This can prove to be quite onerous—particularly in field uses of these devices.

SUMMARY OF THE INVENTION

The present invention has, as one of its objects, to enable one to use a squeeze tube of a plastic caulking material and to control its discharge effectively by means of a trigger on the handle of a compressed gas gun-like dispenser into which the squeeze tube may be inserted and removably contained. The dispenser includes an elongated conically shaped housing defining a cavity, the smaller end of which housing is orificed to permit the nozzle of the squeeze tube to be passed therethrough in an airtight sealed manner. The tube may be inserted through the larger end of the housing into the cavity when a closure cap is removed from such larger end of the housing. Such closure cap may also be sealed onto the larger end of the conical housing when engaged therewith.

Compressed air or gas is selectively admitted into the housing cavity through a handle body which is attached to the lower side of the housing. This handle body includes means to connect it to a hose leading from a source of gas under pressure and a passageway from such connecting means to the housing cavity. Interposed in such passageway is a valving system whereby the passageway is closed in the "at rest" position of the valve and the housing cavity may be simultaneously vented to the atmosphere; and when the trigger is pressed, the valve opens the passageway to connect the source of gas pressure to the housing cavity, but not until the connection between such cavity and the vent to the atmosphere is first closed. Correspondingly, upon release of the trigger, the vent to the atmosphere is not reconnected to the housing cavity until after the passageway from the gas pressure source to the housing cavity is reclosed as the valve means returns to its "at rest" position.

The device of the present invention thus enables one to utilize squeeze tubes of caulking and other materials which are readily available on the market and controllably to dispense all or a portion of their contents. Because of the absence of gas leakage through the valving means and its associated passageways, only a minimum of compressed gas is required for each triggering of the valve means, thereby conserving the amount of gas required—a feature which is particularly important where the device is employed in portable dispensers supplied with gas under pressure from gas bottles for field use.

Should only part of the contents of the squeeze tube be utilized in any particular application, the tube may then be removed from the housing and recapped with its own threaded cap. The plastic nozzle itself may either be cleaned for further use, or simply thrown away and another nozzle supplied for the next use of the tube.

Because of the conical configuration of the housing, better dispensing from the tube is possible in that with the greater volume of gas surrounding the closed end of the tube, more pressure appears to be asserted on the latter end first to flatten the tube from such end toward its discharge end.

Since the tube nozzle is employed to do the actual dispensing of the tacky material, none of the latter comes into contact with any part of the dispenser housing. No cleaning of the latter, therefore, ordinarily becomes necessary.

It will be appreciated, therefore, that a device constructed in accordance with the present invention offers many advantages over available prior art devices in that one may controllably dispense the contents of squeeze tubes through a triggering gas pressure actuated tube holder in which the dispensation is actually accomplished cleanly through the plastic nozzle provided with the tube itself; the tube may be withdrawn from the device after only partial use and reclosed tightly with its own cap; and a minimum of pressurized gas is required by the valving mechanism, thereby saving unnecessary drain on the source of such gas. All these features are attained, moreover, by a dispenser which may be manufactured most inexpensively since much of it may be molded of plastic, and its components may be put together easily and with a minimum of labor costs.

BRIEF DESCRIPTION OF THE DRAWINGS

In the accompanying drawings.

DESCRIPTION OF THE PREFERRED EMBODIMENT

Figures 1, 1A:
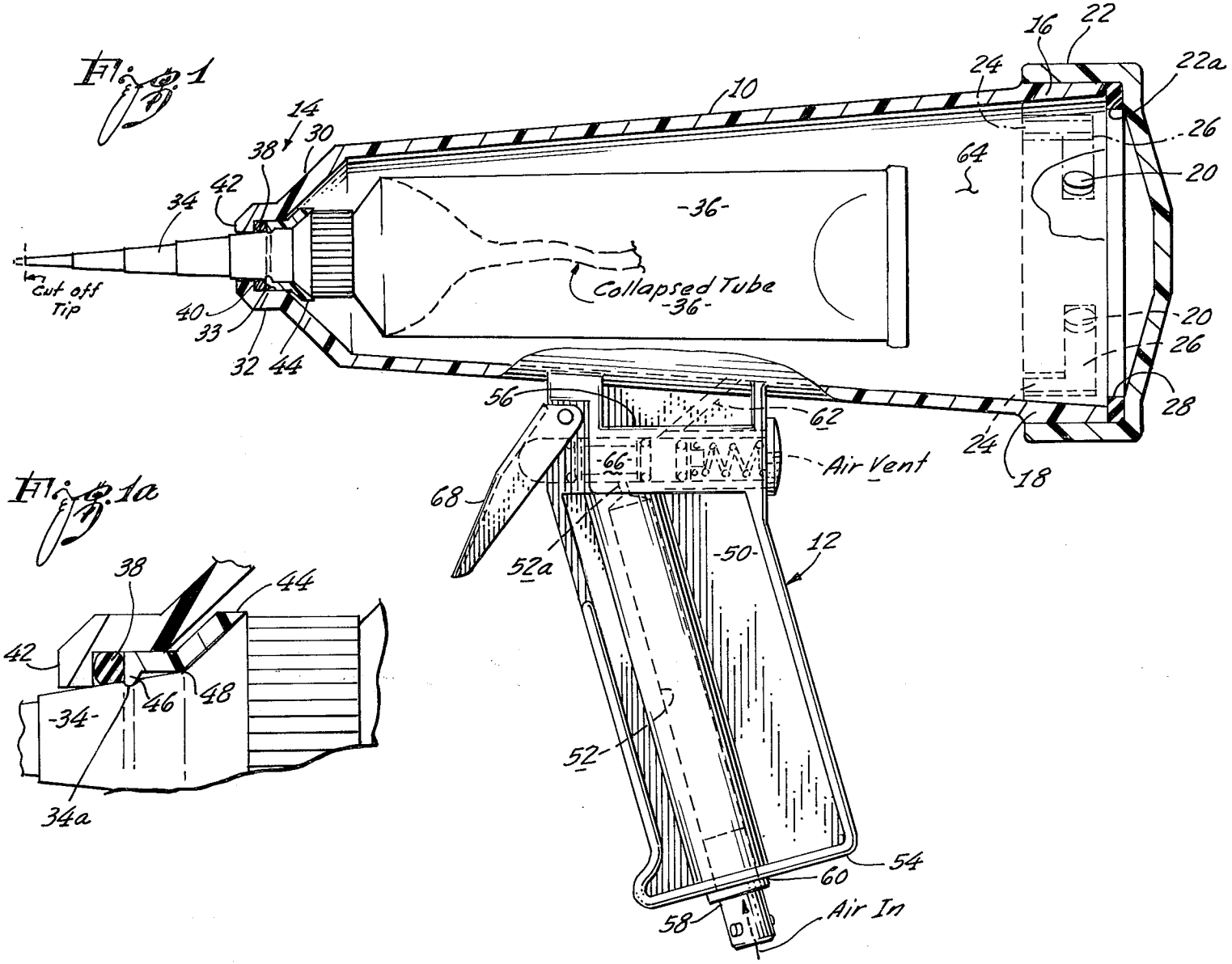
FIG. 1 is a side elevation, partially in section, of a dispenser constructed in accordance with the present invention.
FIG. 1*a* is an enlarged detail, also partly sectioned, of a portion of the nozzle receiving end of the dispenser.

Referring to FIG. 1 of the drawings, a dispenser constructed in accordance with the present invention may be comprised of a housing 10 mounted on top of a handle body 12. The housing 10 is preferably elongated with a conical taper outwardly from its discharge end 14 back to its loading end 16. The latter is defined by a cylindrical segment 18 from which protrude at least two projections 20 which are integrally molded with the housing 10. Desirably, the latter with its projections 20 may be molded of a polystyrene or high-pressure polyethylene.

The loading end 16 of the housing is closed by a cylindrical cap 22 having slotting 24 into which the projections 20 may be received. The slotting 24 desirably extends around at an angle 26 so that when the cap 22 is twisted, the cap may be secured onto the cylindrical segment 18 defining the loading end 16 of the housing 10. To effect an airtight sealing of the loading end 16 when the cap 22 is thus twisted onto the segment 18, a rubber ring 28 should be seated and adhered into the bottom 22*a* of the cap 22.

Figure 2A:
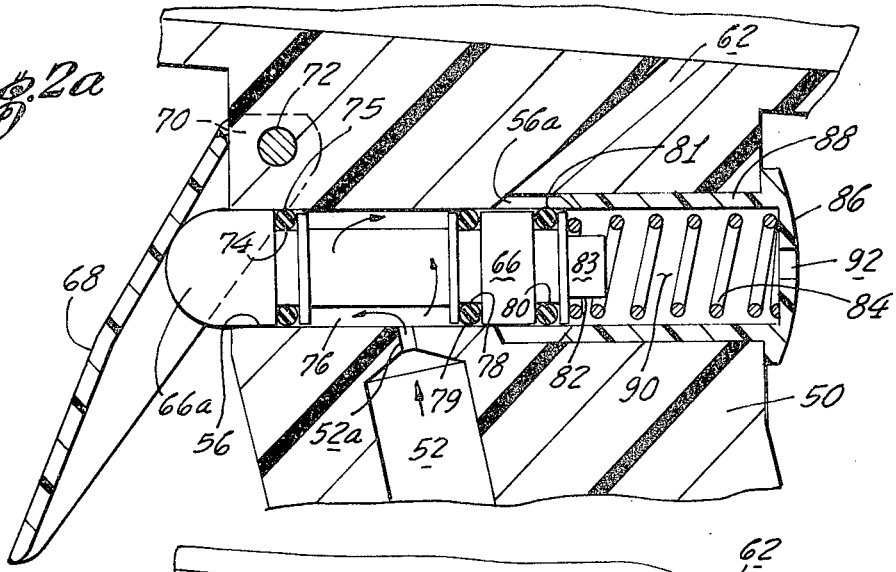
FIG. 2*a* is an enlarged section of the valve mechanism of FIG. 1 in the "at rest" position of the mechanism.

The discharging end 14 of the housing 10 preferably is comprised of a conical segment 30 of more pronounced change in radii than that of the main part of the housing 10, and a cylindrical end 32 defining the orifice 32 through which the nozzle 34 of the squeeze tube 36 is to be pressed and held. In order to seal the nozzle 34 within the orifice 33, an O-ring 38 is provided for seating in an annular transverse wall portion 40 formed by a flange 42 extending radially inwardly from the cylindrical end 32 of the housing 10. A cylindrical conical bushing or grommet 44 is frictionally fitted within the cylindrical end 32 and serves both to hold and seal the tube nozzle 34 within the orifice 33 as well as to provide an annular recess for the O-ring 38. In FIG. 2*a* it may be better seen that the radial dimensions of the flange 42 and the points 46, 48 of the bushing or grommet 44, which points contact the nozzle 34, are such as to conform to the conical shaping of the wall of the nozzle 34.

The housing 10 is mounted on a handle body 12 which preferably may be of a pistol-grip type, and includes an angular body portion 50. A passageway 52 extends from the butt 54 of the body portion 50 to a transverse cylindrical orifice 56. A fitting 58 may be provided at the entrance 60 of the passageway 52 for connection to a hose (not shown) from a tube, bottle or other source (also not shown) of gas under pressure. The passageway 52 is reduced in diameter at 52*a* where it communicates with the transverse orifice 56. Axially offset from where the narrowed passageway 52*a* enters the orifice 56, is a further passageway 62 which extends angularly and rearwardly from the orifice 56 to the cavity 64 defined by the housing 10.

Figure 2B:
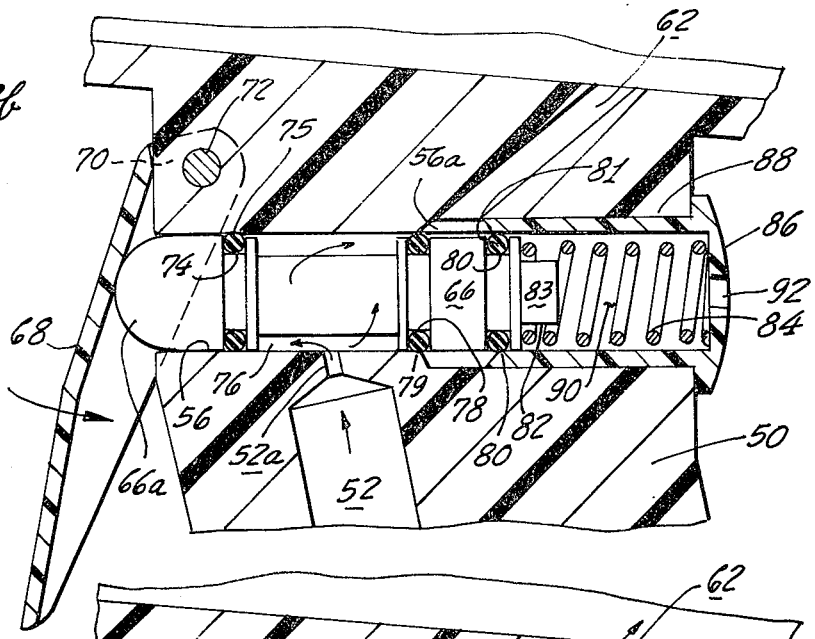
FIG. 2*b* is a section similar to that of FIG. 2*a*, but with the trigger and plunger elements moved partially to the right.
Figure 2C:
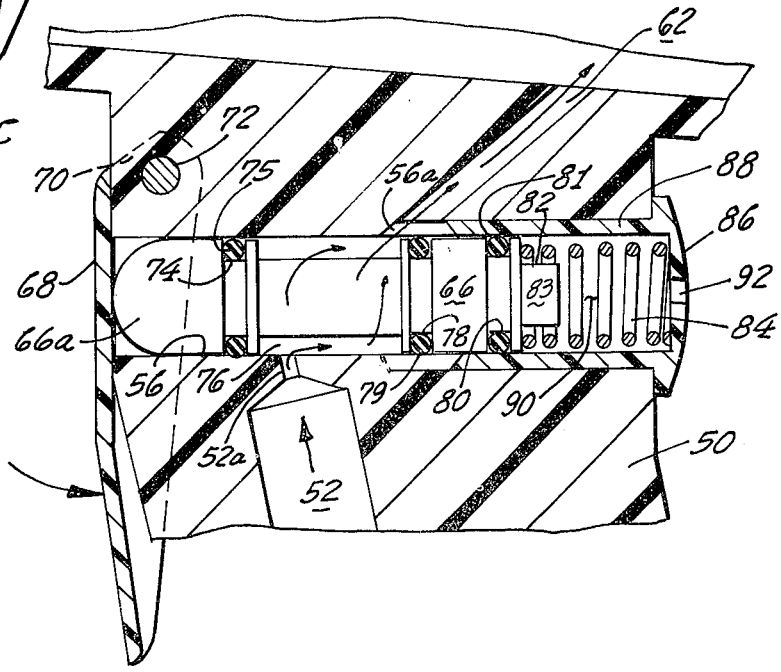
FIG. 2*c* is a section also similar to that of FIGS. 2*a* and 2*b*, but with the trigger and plunger elements moved all the way to the right to its actuating position.

As better seen in FIGS. 2*a*, 2*b* and 2*c*, the valving arrangement of the present invention is comprised of a cylindrical plug 66, one end 66*a* of which may be rounded and protrudes from the orifice 56 to be contacted by a trigger 68. The latter may be pivotally secured in a slot 70 above the orifice 56 by a pin 72. The plug 66 is generally cylindrical and dimensioned to fit tightly but slidably within the orifice 56, and has five annular recesses, 74, 76, 78, 80 and 82. The largest 76 of these recesses serves as the means whereby, when the trigger 68 is pulled and the plug moved to the right as shown in FIG. 2*c*, passageways 52 and 62 are placed in communication with each other so that the gas under pressure which enters passageway 52 through the fitting 58 may enter the cavity 64 of the housing 10. Recesses 74, 78 and 80 each receive and retain an O-ring 75, 79 and 81, respectively. Recess 82 provides an end 83 of diminished diameter which fits within the end of a coiled spring 84 seated in the capped end 86 of the cylindrical sleeve 88. In this connection, the orifice 56 is preferably provided with an increased diameter in its right-hand segment 56*a* to receive in a friction fit the sleeve 88. The latter, however, does not completely fill the segment 56*a*, since the passageway 62 begins at the left-hand end of the segment 56*a*. Sleeve 88 has a hollow core 90 to receive and retain the spring 84 and its capped end 86 is provided with a venting orifice 92.

In use, the cylindrical closure cap 22 is twisted off the housing end 18 and a squeeze tube 36, which has been uncapped and has a plastic nozzle 34 threaded onto its discharge end, is pushed into the cavity to where its nozzle 34 is forced gently through the bushing 44 and the flange 42 into a tight fit. The cap 22 is then replaced on the end 18 of the housing 10 and twisted into an interlock of the projections 20 with the recesses 24. The tip of the nozzle 34 is then cut off to provide the desired discharge diameter.

An air hose is next connected to the fitting 58 whereupon the dispenser is ready to operate. With the pulling of the trigger 68 to where passageways 52 and 62 are placed in communication with each other, the cavity 64 becomes filled with the pressurized gas immediately to commence squeezing of the tube 36, thereby forcing it to discharge its plastic material. However, as soon as the trigger is released the cylindrical valving plug 66 is forced back to its left-hand "at rest" position by the coil spring 84, whereupon the passage 62 is placed in communication with the core 90 and venting orifice 92 through which all of the gas under pressure immediately rushes until it is reduced to the ambient pressure.

It must be noted, however, that the valving arrangment is such that the passage to the vent 92 is always closed before passageway 52 with its gas under pressure is opened to passageway 62; and, conversely, the vent 92 is never in communication with passageway 62 until passageway 52 is withdrawn from communication with passageway 62.

I claim:

1. Air compression means to apply air under pressure to the outside of a squeezable tube containing an extrudable plastic material and having nozzle at one end thereof through which such material is extrudable, said means comprising:

an elongated housing, said housing defining a chamber to receive said tube and having a removable closure at one end and an opening at the other end, said housing receiving said tube with its nozzle disposed in said opening and having sealing means about said opening to seal the tube nozzle therewithin, said sealing means including:

a radially inwardly extending flange at the remote end of the housing defining said opening, an O-ring abutting said flange, and a cylindrical conical grommet, said grommet being dimensioned to fit tightly within the housing portion defining the opening and including an inwardly extending sharp annular rib, said rib serving to bite into the tube nozzle when inserted in said grommet, whereby said nozzle is inhibited from inadvertently being withdrawn from said opening when said chamber is not filled with gas under pressure;

a source of gas under pressure;

passage means connecting said source to said chamber; and valve means interposed in said passage means, said valve means including manual triggering means, whereby the gas under pressure may be selectively admitted through said passage means into said chamber upon manual actuation of said trigger means, and upon release of the trigger means, the gas under pressure in said chamber is vented to the atmosphere.

2. Air compression means to apply air under pressure to the outside of a squeezable tube containing an extrudable plastic material and having nozzle at one end thereof through which such material is extrudable, said means comprising:

an elongated housing, said housing defining a chamber to receive said tube and having a removable closure at one end and an opening at the other end, said housing further being conically shaped with the base of the cone at the removable closure end, and said housing receiving said tube with its nozzle disposed in said opening and having sealing means about said opening to seal the tube nozzle therewithin, said sealing means including:

a radially inwardly extending flange at the remote end of the housing defining said opening, and O-ring abutting said flange, and a cylindrical conical grommet, said grommet being dimensioned to fit tightly within the housing portion defining the opening and including an inwardly extending sharp annular rib, said rib serving to bite into the tube nozzle when inserted in said grommet, whereby said nozzle is inhibited from inadvertently being withdrawn from said opening when said chamber is not filled with gas under pressure;

a source of gas under pressure;

passage means connecting said source to said chamber; and valve means interposed in said passage means, said valve means including manual triggering means, whereby the gas under pressure may be selectively admitted through said passage means into said chamber upon manual actuation of said trigger means, and upon release of the trigger means, the gas under pressure in said chamber is vented to the atmosphere.

* * * * *